United States Patent [19]

Roszler

[11] 4,027,377

[45] June 7, 1977

[54] PRODUCTION OF NEUTRON SHIELDING MATERIAL

[75] Inventor: John J. Roszler, Lincoln Park, Mich.

[73] Assignee: Brooks & Perkins, Incorporated, Southfield, Mich.

[22] Filed: June 25, 1975

[21] Appl. No.: 590,206

[52] U.S. Cl. ..... 29/420.5; 250/517

[51] Int. Cl.[2] ..... B22F 3/24

[58] Field of Search ..... 250/517; 29/420, 420.5

[56] References Cited

UNITED STATES PATENTS

| | | | |
|---|---|---|---|
| 2,379,232 | 6/1945 | Hensel | 29/420 X |
| 2,727,996 | 12/1955 | Rockwell et al. | 250/217 |
| 3,235,954 | 2/1966 | Fromson | 29/420 |
| 3,474,516 | 10/1969 | Finlay et al. | 29/420.5 X |
| 3,615,901 | 10/1971 | Medicus | 29/420.5 |
| 3,671,230 | 6/1972 | Smythe et al. | 29/420.5 |
| 3,676,916 | 7/1972 | Schierding et al. | 29/420 |
| 3,685,134 | 10/1972 | Blue | 29/420.5 |
| 3,774,289 | 11/1973 | Cacace et al. | 29/420.5 |
| 3,857,157 | 12/1974 | Smith et al. | 29/420.5 |

FOREIGN PATENTS OR APPLICATIONS

| | | | |
|---|---|---|---|
| 252,422 | 9/1960 | Australia | 250/517 |

*Primary Examiner*—C.W. Lanham
*Assistant Examiner*—V. K. Rising
*Attorney, Agent, or Firm*—Whittemore, Hulbert & Belknap

[57] ABSTRACT

Neutron shielding material in the form of a thin rigid sandwich, comprising outer layers of metal, preferably aluminum, and a solid core formed of a uniform intimate solid mixture of particles of metal and a neutron absorbing material, preferably boron carbide ($B_4C$). The sandwich is made by initially forming an open-sided welded box from metal plates, preferably aluminum, leaving one end open. Uniformly and intimately mixed particles of the metal powder, preferably atomized aluminum, and the neutron absorbing material, preferably boron carbide having an approximate range of 20–200 mesh particle size, is placed in the box so as to completely fill it, and the open end is closed by welding another metal plate in position. Openings are provided in the ends of the box for the escape of air, the box is heated to approximately 800°–850° F., and is then rolled to required thickness, as for example 0.125 or 0.250 inch.

13 Claims, 1 Drawing Figure

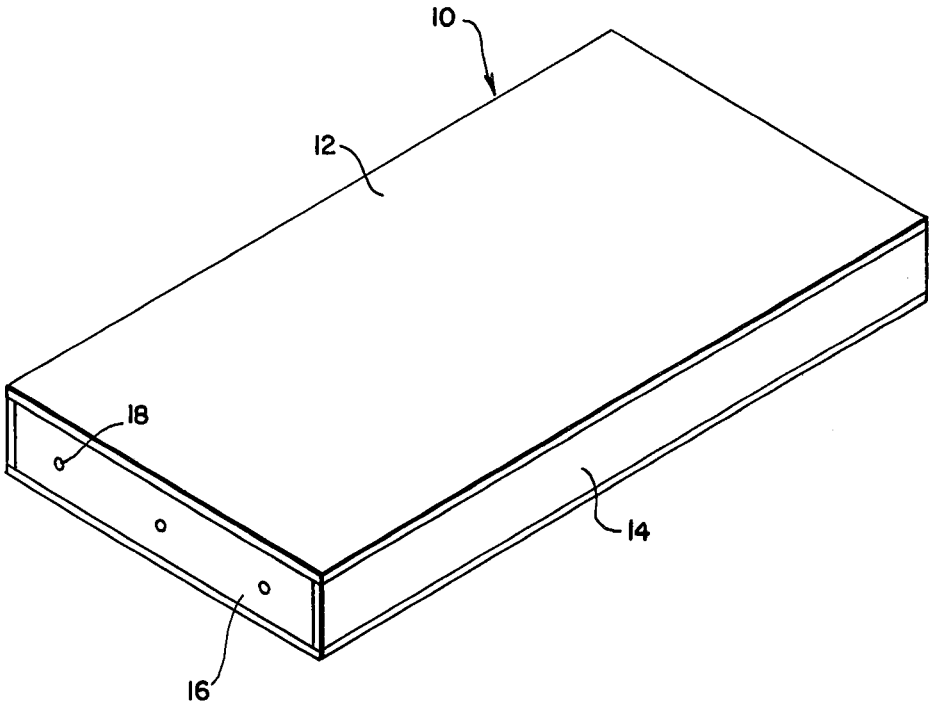
10
12
18
14
16

PRODUCTION OF NEUTRON SHIELDING MATERIAL

BRIEF SUMMARY OF THE INVENTION

The neutron shielding material produced in accordance with the present invention is substantially similar to that described in prior U.S. Pat. No. 2,727,996, assigned to the United States of America as represented by the United States Atomic Energy Commission.

The prior patent discloses the production of a core material to be provided in a sandwich between two thin sheets of metal, such as aluminum, by an operation in which a first metal, for example aluminum, is melted, and thereafter the neutron absorbing material, preferably BC ($B_4C$), is added to the melted aluminum and stirred to provide an intimate uniform mixture. Thereafter, the mixture is cooled, the metal sheathing is applied, and the sheathed mixture is rolled to a desired thickness.

An improved method of producing the neutron absorbing material forms the subject matter of the present invention.

In the present case, a rectangular box is formed of a suitable metal, preferably aluminum plate, one end of the box being left open. The edges of the plates forming the box are welded together.

A mixture of the neutron absorbing material, preferably boron carbide, and finely divided metal powder, preferably atomized aluminum, is separately prepared and thoroughly mixed to insure that the neutron absorbing material is distributed throughout the mixture with substantially complete uniformity. Thereafter, the mixture is supplied to completely fill the box. In order to insure against voids in the metal sheathing material; the sides of the box are struck soundly with a sledge hammer or the like to cause the material to compact and settle. Sufficient additional powdered mixture is supplied if necessary to insure that the box is completely filled.

Thereafter, the plate is inserted in the open side of the box and is welded completely around its periphery to form a complete enclosure.

In order to provide for subsequent escape of air, if any is entrapped in the enclosure, openings are provided in one or both ends of the box.

Thereafter, the box is brought to a temperature below the melting point of the metal powder, preferably 800°–850° F. in the case of aluminum powder, and the box is rolled to reduce its thickness to the desired amount. The hot rolling causes the particles of metal powder and the particles of boron carbide to become metallurgically bonded together or sintered so that in subsequent use the material retains its neutron absorbing properties.

BRIEF DESCRIPTION OF THE DRAWING

The FIGURE illustrates a box in completed form prior to rolling.

DETAILED DESCRIPTION

In accordance with the present invention, neutron shielding material is provided by an operation in which an open-ended box, generally designated 10, is initially provided.

It will be understood that boxes of different sizes may be employed and that subsequent operations may produce neutron absorbing material of different thicknesses. However, by way of specific example, a box having external dimensions of 4 × 19 × 37 inches is produced by welding together two 0.500 × 19 × 37 inch plates 12, two 0.500 × 3 × 37 inch side strips 14, and two 0.500 × 3 × 18 inch end strips 16. In order to produce smooth edges facilitating the production of satisfactory welding, these plates are sawed from larger stock.

The box is completed by providing a smooth welded junction between the edges of the pieces to produce an open-ended box having an opening 3 × 18 inches therein. It is important in producing the welding that all surfaces to be flowed are clear and free of foreign matter. The weld will be formed by a continuous, neat, even flow. No voids at any point in the weld are permitted as this will mean a structural weakness in the box or ingot and cause it to break open during subsequent rolling.

The raw material for filling the box is now prepared and this material comprises the neutron absorbing material, which in the preferred embodiment of the invention is boron carbide grit or powder, and the metal powder, such for example as atomized aluminum. In practice, neutron shielding material is made in different grades with different proportions of neutron absorbing material and metal powder. These grades may for example be 35 percent by volume of the neutron absorbing material or 50 percent by volume of this material.

The powdered material is thoroughly mixed to insure substantially absolute uniformity. For this purpose, it is preferred to place the required amounts of powdered material in a power mixer and agitate the same until uniform distribution of one material throughout the other has been produced. This completely mixed material is then fed into the open-ended box, as for example by a hand scoop. The box is completely filled, and to insure that the powdered material is settled and compacted, and to eliminate any substantial inclusion of air, the sides of the box are struck soundly with a sledge hammer, or the filled container may be vigorously vibrated to accomplish the same purpose. Finally, the open end of the box is closed by the metal plate cut to the required dimensions, and as inserted, this plate will abut solidly against the material in the box. This plate is then welded in place using the same precautions as in the original production of the open-ended box.

After the end piece has been welded into position, small openings 18 are provided in each end of the box, as for example three ¼ inch holes are drilled and are then temporarily closed by the insertion of ¼ inch aluminum rivets. These rivets operate as plugs and hold the material in the boxes until they are to be rolled. The ingots formed by the filled and welded boxes with the openings in the ends thereof closed by the plugs are ready for rolling and may be transferred to the rollable ingot inventory.

When the ingots are to be rolled, the plugs are removed from the drilled holes in the ends of the ingots to permit the escape of any entrapped air. The ingots are then stackloaded in a soaking furnace and preferably 1 inch spacers are provided between ingots to permit uniform heat-up from all sides. The furnace temperature is held at 875° and the ingots are soaked for approximately 12 hours, at which time the ingot metal temperature will be between 800° and 850° F. throughout, the best range for rolling.

In the rolling operation the work roll temperature should only be that amount of heat gained from a normal warm-up plate. The ingot is passed between the rolls straight away until the slab has attained a length of approximately 53 inches. The slab is then turned 90° and the balance of the rolling is done broadside until the final gauge is reached.

The usual neutron absorbing material is supplied in two finished gauges; namely, 0.125 and 0.250 gauge. It has been found that the ingots of the dimensions described above are completed to the final gauge in eight or more passes.

Following rolling, the neutron absorbing sheet material is flattened. For this purpose it may be thermal flattened under weights or it may be flattened using a small coil set remover. However, the thermal flattening in an oven is preferred. To accomplish this the sheet material is placed in stacks under heavy weights in an oven at a temperature of about 800° F. for a time of an hour for each inch of plate being allowed. If not all plates are flattened at the end of the cycle those which are flat are removed, the balance are turned over and recycled.

After the sheet material has been flattened it is cut to the required size. This conveniently may be accomplished with a guillotine shear. The material cuts very easily and contrary to what might be expected, does not cause excessive wear to the shear blades. Due to the sandwich core the guillotine cut results in a very neat edge when contrasted to cutting a ¼ inch piece of aluminum.

It may be noted that the neutron absorbing material normally requires certification, which means that the manufacturer must analyze each ingot produced. This is accomplished by weighing out approximately 5 grams of the mixture of boron carbide and aluminum. This mixture is dissolved in 100 cc of water and 100 cc of 1-to-1 reagent grade hydrochloric acid, and the solution is filtered in a tared Gooch crucible. The filtered material is dried at 600° F. for 1 hour and is cooled in a dessicator. The residue will be boron carbide and is weighed to determine the percentage of boron carbide by weight in the original core sample.

It will be understood that the rolling operation reduces not only the thickness of the mixture of boron carbide and aluminum powder, but also reduces the thickness of the plates 12 constituting opposite outer covers on the finished material. Depending upon the final thickness of the sandwich, the aluminum sheathing on opposite sides may have a thickness of approximately 0.020 or 0.040 inch, the interior of the sandwich of course being formed of the molecular bonded particles of neutron absorbing material and aluminum or other metal powder, the core being permanently molecularly bonded to the interior surfaces of the external sheathing.

While the precise dimensions can be varied as required, it is desirable to reduce the thickness of the ingot by rolling to not more than 1/30th of its original thickness, and to reduce the aluminum sheathing at opposite sides of the rolled material to a thickness not thinner than 0.010 inch.

While the foregoing description refers to aluminum as the powdered material which is intimately mixed with the finely divided boron carbide, useful products may also be obtained where the powdered metal is magnesium or stainless steel.

What I claim as my invention is:

1. The method of making rigid neutron absorbing sheet material which comprises forming an open-ended rectangular metal box by continuously welding together the edges of rectangular top and bottom forming plates, side forming strips, and one end forming strip, mixing together finely divided neutron absorbing boron compound and a finely divided metal powder to produce a substantially uniformly dispersed mixture thereof, positioning the box with its open end up, completely filling the box with material from the uniform mixture, jarring the filled box repeatedly to cause the finely divided mixture to settle to eliminate voids or air pockets in the box, adding material from the mixture as required to ensure that the box is filled, applying the other end forming strip to the box in solid abutment against the powdered material and providing a continuous weld around its edges to the adjacent end edges of said top and bottom forming plates and side forming strips to produce a composite ingot suitable for rolling, soaking the ingot to bring it to an elevated temperature of 800°–850° F., and hot rolling the ingot at substantially the aforesaid temperature in repeated passes to reduce its thickness to form a thin rigid neutron absorbing sheet material in which the particles of finely divided neutron absorbing material and metal powder are molecularly bonded together and to the inner surfaces of the thin metal outer plies produced from the top and bottom forming plates.

2. The method as defined in claim 1 which comprises shearing the edges of the sandwich to form rigid neutron absorbing sheet material to required dimensions.

3. The method as defined in claim 1 which comprises forming openings in an end wall of the box prior to rolling.

4. The method as defined in claim 3 which comprises the step of plugging the openings with removable plugs to produce storable ingots, and removing the plugs prior to rolling.

5. The method as defined in claim 1 in which the neutron absorbing material is $B_4C$.

6. The method as defined in claim 5 in which the metal powder is essentially aluminum, magnesium or stainless steel. .

7. The method as defined in claim 6 in which the material of the plates and strips from which the box is formed by welding is essentially aluminum.

8. The method as defined in claim 7 in which the box forming plates and strips have an initial thickness prior to rolling of at least ½ inch.

9. The method as defined in claim 7 in which the thickness of the ingot prior to rolling is several times the thickness of the rolled material.

10. The method as defined in claim 7 in which the thickness of the ingot is reduced by rolling to not more than 1/30th of its original thickness.

11. The method as defined in claim 7 in which the thickness of the aluminum sheathing on the exterior of the rolled material is not less than 0.010 inch.

12. The method as defined in claim 7 which comprises flattening the rolled material after rolling.

13. The method as defined in claim 12 in which the flattening step comprises thermal flattening by heating a stack of a plurality of pieces of rolled material under heavy weights.

* * * * *